US009968811B2

(12) United States Patent
Lenz, Jr. et al.

(10) Patent No.: US 9,968,811 B2
(45) Date of Patent: May 15, 2018

(54) FIREFIGHTING OR RESCUE APPARATUS INCLUDING AN EXTENDABLE CROSSLAY HOSE BED

(71) Applicant: HME, Incorporated, Wyoming, MI (US)

(72) Inventors: Kenneth C. Lenz, Jr., Hudsonville, MI (US); Kevin J. Longhurst, Grand Rapids, MI (US)

(73) Assignee: HME, Incorporated, Wyoming, MI (US)

( * ) Notice: Subject to any disclaimer, the term of this patent is extended or adjusted under 35 U.S.C. 154(b) by 299 days.

(21) Appl. No.: 14/669,867

(22) Filed: Mar. 26, 2015

(65) Prior Publication Data

US 2015/0273254 A1 Oct. 1, 2015

Related U.S. Application Data

(60) Provisional application No. 61/973,509, filed on Apr. 1, 2014.

(51) Int. Cl.
*A62C 27/00* (2006.01)

(52) U.S. Cl.
CPC ..... *A62C 27/00* (2013.01)

(58) Field of Classification Search
CPC ..... A62C 27/00; A62C 31/00; A62C 33/00
USPC ..... 169/24, 52, 62
See application file for complete search history.

(56) References Cited

U.S. PATENT DOCUMENTS 2,784,027 A 3/1957 Temp
4,830,242 A 5/1989 Painter
4,830,421 A * 5/1989 Hawelka ..... A62C 27/00 169/24
5,658,032 A 8/1997 Gardner
6,006,841 A * 12/1999 Hunke ..... A62C 27/00 137/355.2
6,065,792 A 5/2000 Sciullo et al.
6,601,895 B1 8/2003 Tannenbaum et al.
6,929,302 B1 8/2005 Demick et al.
7,083,219 B1 8/2006 Gregory
7,419,203 B2 9/2008 Chandler et al.
8,075,036 B2 * 12/2011 Hancock, Sr. ..... A62C 27/00 296/26.08

(Continued)

OTHER PUBLICATIONS

Encyclopaedia Britannica, "Chain", Jul. 20, 1998, <https://www.britannica.com/technology/chain-connecting-device>.*

*Primary Examiner* — Christopher Kim
*Assistant Examiner* — Cody Lieuwen
(74) *Attorney, Agent, or Firm* — Warner Norcross and Judd, LLP

(57) ABSTRACT

A firefighting or rescue apparatus includes an extendable crosslay hose bed which facilitates access to the crosslay bed for loading and pulling flexible fire hose. The bed is mounted to a frame, generally behind the cab of the apparatus, which can be a fire truck. The bed includes a moveable tray extending laterally, across a width of the truck. The tray can be oriented generally perpendicular to a longitudinal axis of the truck as well. The tray and/or an optional underlying support frame can be coupled to a power unit adapted to extend and retract the support frame and moveable tray from stored position to a deployed position. A control can be in communication with the power unit and operable by a user to control movement of the tray from the stored position to the deployed position.

19 Claims, 11 Drawing Sheets

(56) References Cited

U.S. PATENT DOCUMENTS

| | | | | |
|---|---|---|---|---|
| 2006/0118149 | A1* | 6/2006 | Benson | B08B 3/026 134/123 |
| 2007/0182185 | A1 | 8/2007 | Nichols | |
| 2009/0250232 | A1* | 10/2009 | Wielgat | A62C 3/02 169/70 |
| 2010/0252597 | A1* | 10/2010 | Sandness | B60R 9/02 224/539 |
| 2011/0250041 | A1* | 10/2011 | Wissler | B66F 11/00 414/546 |
| 2013/0098643 | A1* | 4/2013 | McLoughlin | A62C 33/04 169/46 |

* cited by examiner

FIREFIGHTING OR RESCUE APPARATUS INCLUDING AN EXTENDABLE CROSSLAY HOSE BED

BACKGROUND OF THE INVENTION

The present invention relates to a firefighting apparatus, such as a fire truck, a trailer or other vehicle, and more particularly to a firefighting apparatus including an extendable crosslay hose bed.

There are a variety of fire trucks and rescue vehicles that include storage areas for storing flexible fire hose and other equipment useful in rescue and firefighting operations. Typically, fire hose has dedicated storage areas on a chassis of a fire truck. These storage areas come in many forms. One is a side stack hose bed which generally is a box shaped container located in a rearward part of the truck. The side stack hose bed is mounted over the rear axle of the truck, and extends longitudinally, aligned parallel to a longitudinal axis of the truck. The fire hose is carefully folded over and over upon itself in one or more special lay patterns, and stacked in one or more stacks in the side stack hose bed.

Another storage area is a crosslay hose bed. A crosslay hose bed is a container or bed that lies across or perpendicular to the longitudinal axis of the truck. A crosslay hose bed typically extends across the entire width of the truck so that the hose can be selectively accessed from either the driver or passenger side of the truck.

Conventional crosslay hose beds frequently are mounted high on the truck. One reason for this is so that a user can throw several layers or lengths of hose over their shoulder and pull the hose from the crosslay hose bed. Another reason is because the hose bed may be mounted over a pump or other control on the truck to conserve space. Whatever the reason, the location and orientation of the crosslay hose bed makes it somewhat difficult and cumbersome to load the fire hose in the crosslay hose bed after use of the hose has ceased. Many times, a user accesses an upper deck of the truck to reach and neatly stack the hose in the crosslay hose bed. In some cases, the truck will be outfitted with a dedicated standing platform extending across the truck. A user will stand on this platform to access the crosslay hose bed and load it with hose. This platform, however, can consume needed space on the truck.

Thus, while crosslay hose beds and other storage beds on fire trucks are currently available and helpful in a variety of situations, there remains room for improvement in their function, operation and utilization.

SUMMARY OF THE INVENTION

A firefighting or rescue apparatus is provided including an extendable crosslay hose bed that enhances access to itself for the loading and/or pulling of a fire hose.

In one embodiment, the extendable crosslay hose bed is mounted to a frame of the apparatus, in a rearward portion of the apparatus. The crosslay hose bed can be mounted behind a cab of the apparatus, particularly where the apparatus is a fire truck. The crosslay hose bed can also be mounted over an underlying pump or drivetrain of the truck.

In another embodiment, the crosslay hose bed includes a moveable tray extending laterally, across at least a portion of a width of the truck. The tray can be oriented generally perpendicular to a longitudinal axis of the truck as well. The moveable tray can be mounted on a support frame that is further coupled to a power unit adapted to extend and retract the support frame and moveable tray from stored position to a deployed position.

In a further embodiment, the crosslay hose bed includes a power unit coupled to the tray and/or support frame. The power unit is adapted to extend and retract the support frame and/or moveable tray from a stored position to a deployed position, and vice versa. Optionally, a control can be in communication with the power unit and operable by a user to selectively control movement of the tray from the stored position to the deployed position.

In still another embodiment, in the deployed position, the tray extends laterally from a side of the truck a preselected distance. The distance can be sufficient to enable a user to load and stack hose on the tray when in the deployed position. In some cases, the preselected distance can be about 1 foot to about 8 feet.

In yet another embodiment, the crosslay bed can include one or more waterways mounted thereto. The waterways can be mounted to the tray or the bed frame, depending on the application. The waterways can be relatively rigid, elongated, self-supporting tubular sections that telescope and slide relative to one another. The waterways can be in a shortened mode when the crosslay bed frame and/or tray is in its stored position and in an extended mode when the crosslay bed frame and/or tray is in the deployed position.

In even another embodiment, the tray and/or frame can define one or more apertures through which connectors extend. The connectors can be configured to connect the waterways to fire hose disposed in the crosslay bed. In this manner, firefighting fluid can be provided through the waterways, to the fire hose via the connectors.

In a further embodiment, the crosslay bed can include one or more valves mounted adjacent the connectors to regulate or meter the flow of firefighting fluid conveyed from the waterways to the fire hose. The valves can be operated via a control panel in mechanical or electrical communication with them. Optionally, the control panel can be mounted on an externally facing portion of the tray and/or frame, so that the control panel is accessible by a user to operate the crosslay bed while the tray and/or frame is in the stored position.

The current embodiments provide a simple and effective construction that can facilitate enhanced access to a crosslay hose bed. This can be helpful when loading fire hose on the bed and/or pulling the hose from the bed. Where the bed is located lower on the truck, the bed can be stacked or loaded with fire hose by a user standing on the ground. This can be helpful, and can minimize unintentional dropping of the hose and/or improper stacking and loading of the hose.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
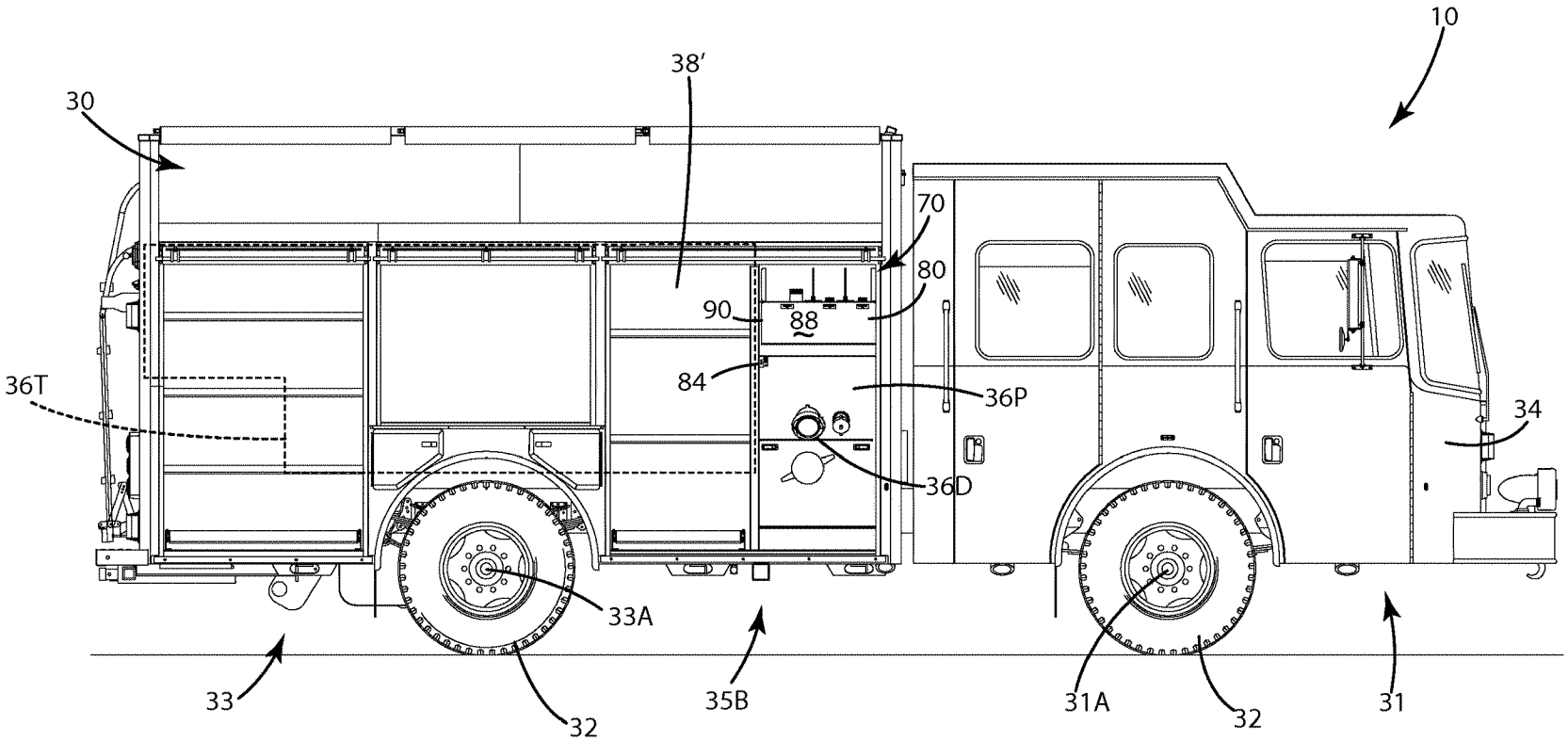
FIG. 1 is a side view of a firefighting apparatus in the form of a fire truck including an extendable crosslay hose bed according to a current embodiment, with a tray of the extendable crosslay hose bed in a stored position.

A current embodiment of a firefighting apparatus is illustrated in FIGS. 1-12 and generally designated 10. As shown there, the firefighting apparatus is in the form of a pumper fire truck that is configured to pump large volumes of firefighting fluid from a fluid source, through one or more fire hoses, onto a fire to extinguish or suppress the fire. Although referred to as a firefighting apparatus, as used herein, that term can also include a variety of emergency vehicles, rescue vehicles and other modes of transportation such as aerial ladder trucks, trailers or other equipment. Generally, the apparatus, also referred to herein as a fire truck, can be a self-propelled and mobile vehicle.

The frame 30 of the fire truck 10 can be mounted to a chassis which can be further mounted to multiple wheels 32. The wheels can be attached to conventional front and rear axles, which can be attached to the chassis of the truck. The fire truck can be mobilized via an internal combustion engine which drives the wheels via a transmission.

The fire truck 10 can include one or more internal electronic or computer controls that can operate the engine, transmission, or steering control mechanism to enable the front wheels to be steered upon transport to an emergency location. As used herein, an emergency location can be a scene of a traffic accident, a boating accident, a plane accident, a man-made or natural disaster, and/or a terrorist attack, or any other location where one or more victims' lives are endangered or otherwise compromised.

The frame 30 can include a forward portion 31 and a rearward portion 33 located at opposite ends of the fire truck 10. Optionally, although referred to as a frame, this structure can include one or more body components attached to it. Generally, the rear wheels 32 and the associated rear axle 33A are located in the rearward portion 33 of the fire truck 10. The front or steering wheels 32 can be located in the forward portion 31 of the fire truck. The frame 30 in the forward portion 31 can include a cab 34. The cab 34 can house occupants, such as firefighters or rescue personnel, as they are transported to and from an emergency location. The cab 34 can include conventional controls, such as a steering mechanism and various displays inside the cab to monitor and evaluate the operation of the vehicle 10. The cab can terminate a distance of several feet rearward of the front wheels 32, or generally forward of the pump controls and/or rearward portion 33 of the fire truck 10.

The wheels 32 can be mounted on one or more axles, for example a front axle 31A and a rear axle 33A. The front axle 31A can be located in the forward portion 31 and the rear axle can be located in the rearward portion 33. The front axle can include a steering system to enable the front wheels to be steered. The rear axle can have one or more drive components to assist in propelling the truck 10. The rear axle can be joined with a transmission of the vehicle with a drive shaft (not shown).

Although shown with a single rear axle 33A, the apparatus or truck described herein can include multiple rear axles. In such a construction, the crosslay hose bed can extend across the truck, forward of all the rear axles, and optionally rearward of the front axle and/or cab 34.

On the frame, behind the cab 34, a pump control panel (not shown) can be mounted. Under or behind the pump control panel, one or more pumps 36P can be mounted. These pumps can be mounted to the frame. Generally, the pumps can be in fluid communication with a firefighting fluid tank 36T mounted to the frame in the rearward portion 33 and/or a source of firefighting fluid external to the truck, such as a fire hydrant. The pumps also can be in fluid communication with one or more hoses or waterways 40 as described below. The pumps can be configured to convey firefighting fluid from the external source or the tank to the waterways 40 to one or more fire hoses in a forced manner so that the firefighting fluid can be applied to a fire.

Figure 3:
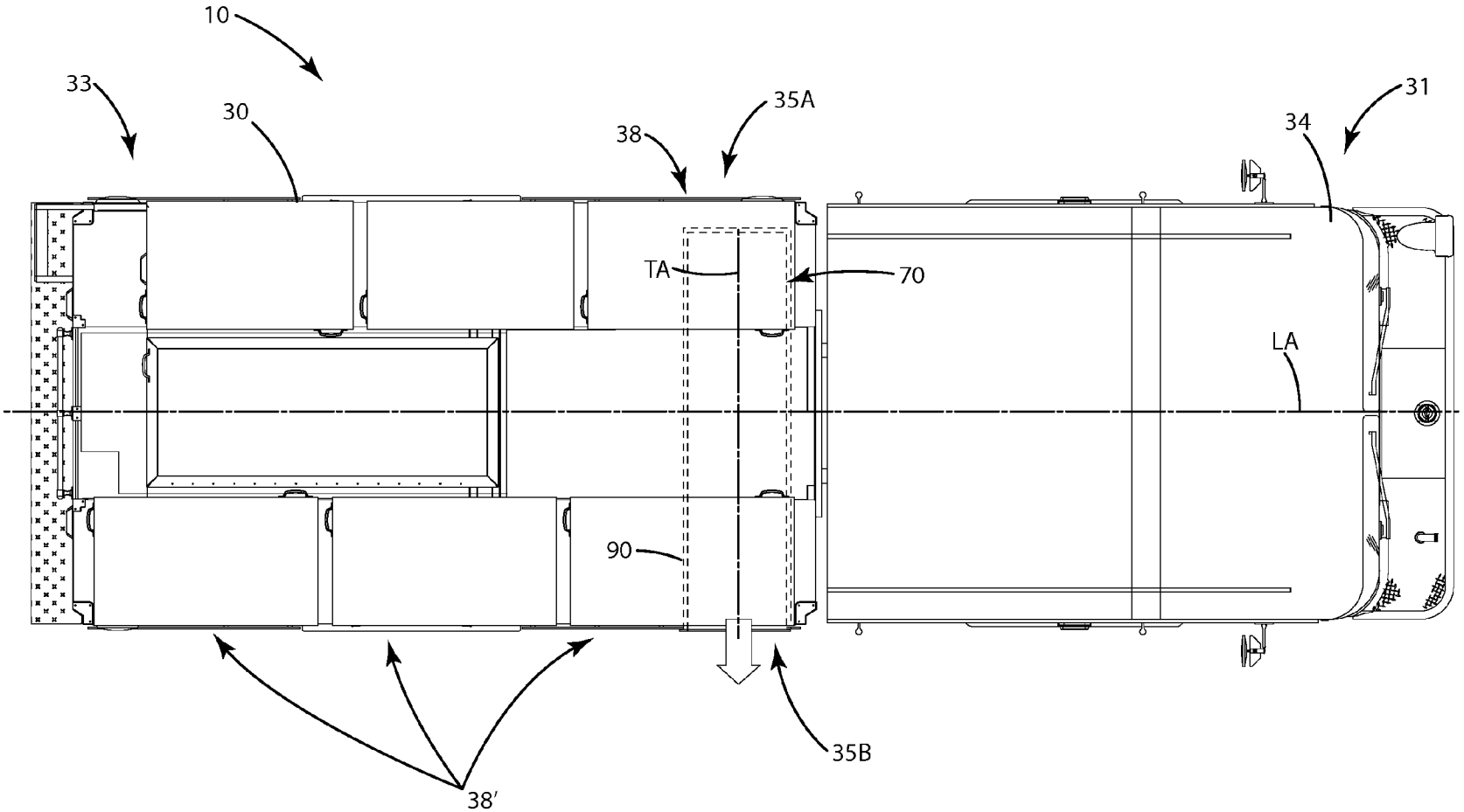
FIG. 3 is a top view of the apparatus with the tray in a stored position.

The frame 30 optionally can include first compartments or lockers 38 mounted rearward in the rearward portion 33 of the fire truck 10 on the first side or driver's side 35A as shown in FIG. 3. These compartments optionally can be located on and accessible from the first side 35A of the fire truck, and can be sized and configured to store supplies and equipment useful for easy access at an emergency location. Multiple lockers or compartments can fill a substantial portion of the side 35A in the rearward portion 33. Some compartments 38 can be mounted forward of the rear axle, some over the rear axle, and some rearward of the rear axle. Generally, all the compartments on side 35A can be located rearward of the crosslay hose bed 70. Further optionally, the compartments 38 can be rearward of the front axle and rearward of the cab 34.

The frame 30 also can include second compartments or lockers 38' mounted rearward of the pump discharge 36D, generally in the rearward portion 33 of the fire truck 10 on the second side or passenger side 35B as shown in FIG. 1. These compartments optionally can be located on and accessible from the second side 35B of the fire truck, and can be sized and configured to store supplies and equipment useful for easy access at an emergency location. Optionally, the second compartments 38' can be located substantially only forward of the rear axle 33A. Further optionally, the second compartments 38' can be rearward of the front axle, rearward of the pump discharge 36D rearward of the cab 34, and rearward of the crosslay hose bed 70.

The fire truck 10 includes a crosslay hose bed 70 as mentioned above. The crosslay hose bed 70 can include multiple components that enable a tray 80 to extend from a stored position (FIGS. 1-3) to a deployed position (FIGS. 4-6) where flexible fire hose FH supported by the tray can be easily accessed and/or loaded back onto the tray after use. Generally, the crosslay hose bed includes a compartment 90 defined by the frame 30 of the truck. The compartment 90 can be disposed above the drive train of the truck and optionally above some certain pumps and other mechanical apparatus of the truck. The compartment 90 can extend across all or a portion of the width W of the truck (FIG. 10).

The compartment 90 can be of a box shape forming a container that is substantially transverse to the longitudinal axis LA of the truck. Due to the lay of the compartment, the tray 80 as described further below is transverse to the longitudinal axis of the truck and moves along a tray access TA. As shown in FIG. 3, the tray axis TA is transverse, and optionally perpendicular to the longitudinal axis LA of the truck.

Figure 7:
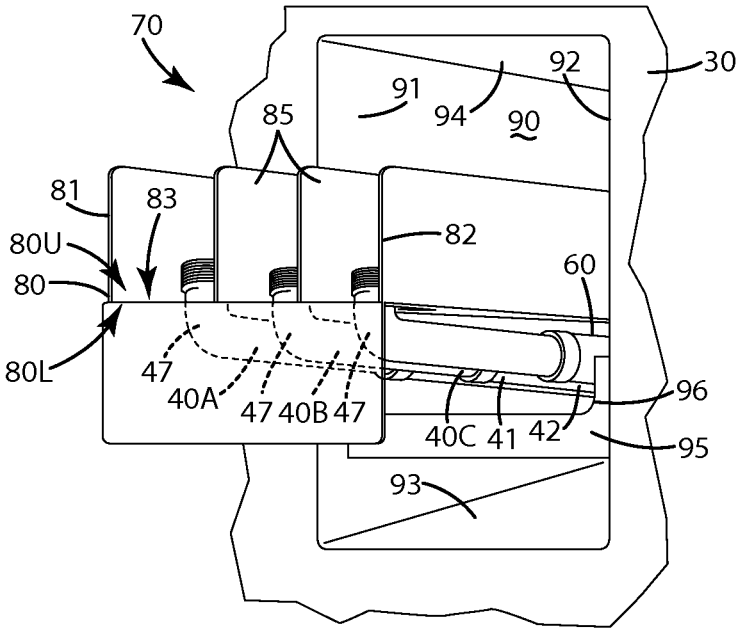
FIG. 7 is a close up perspective view of the tray in the partially deployed position.
Figure 7A:
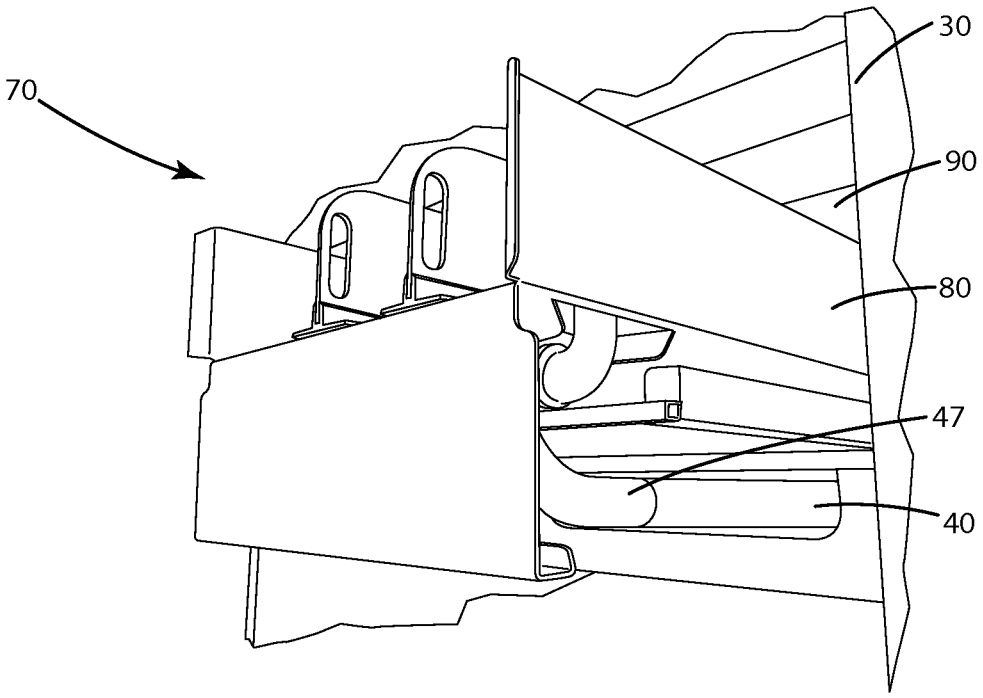
FIG. 7A is an image of the tray in the partially deployed position.
Figure 8:
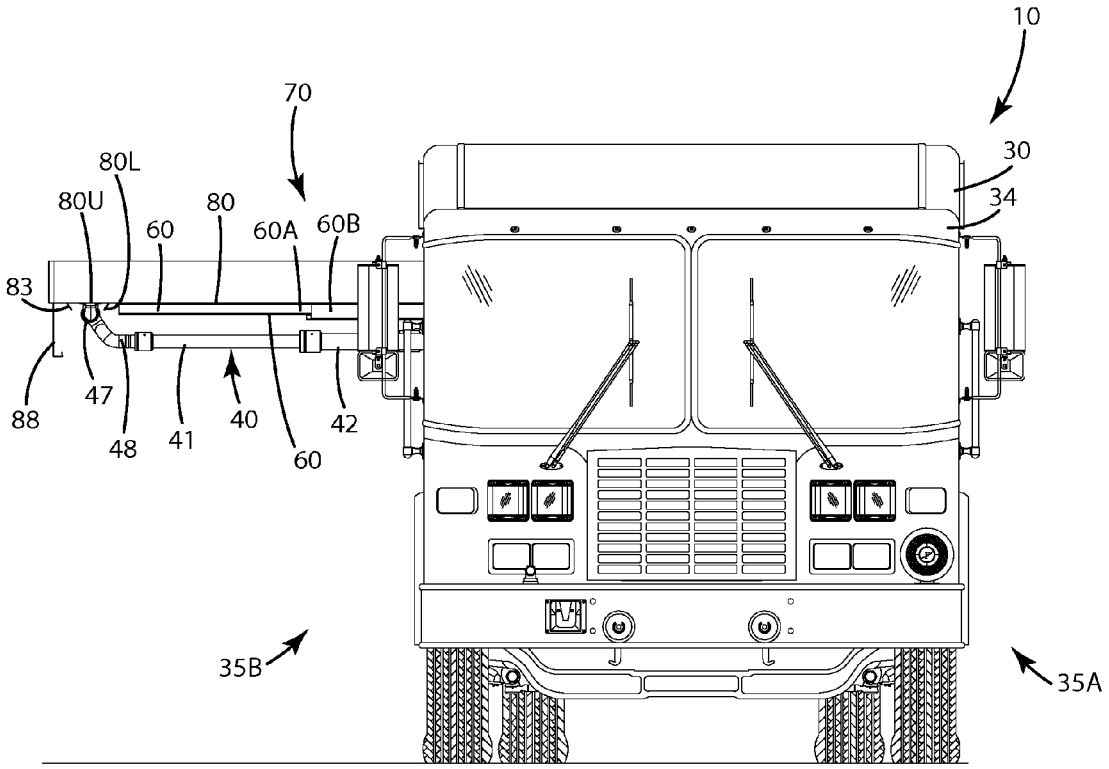
FIG. 8 is a front view of the apparatus with the tray in the deployed position.
Figure 10:
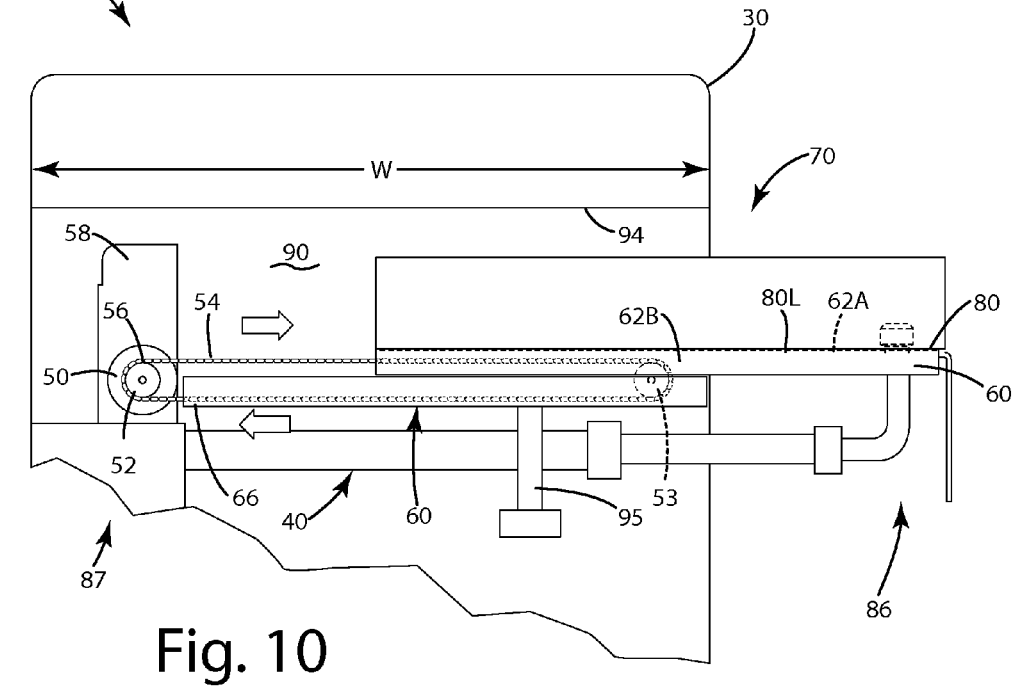
FIG. 10 is a partial view of the tray supported on the support frame being deployed to a deployed position.

The compartment 90 can include first 91 and second 92 sidewalls, a bottom 93 and a roof 94, as shown in FIGS. 7 and 10. The roof 94 can generally protect the fire hose FH from the elements when being transported in the crosslay hose bed 70. The bottom 93 can include supports 95 that support a portion of a support frame 60 associated with the tray 80. The supports 95 can include cutouts or recesses 96 to accommodate or make space for the waterways 40 as described further below.

Figure 2:
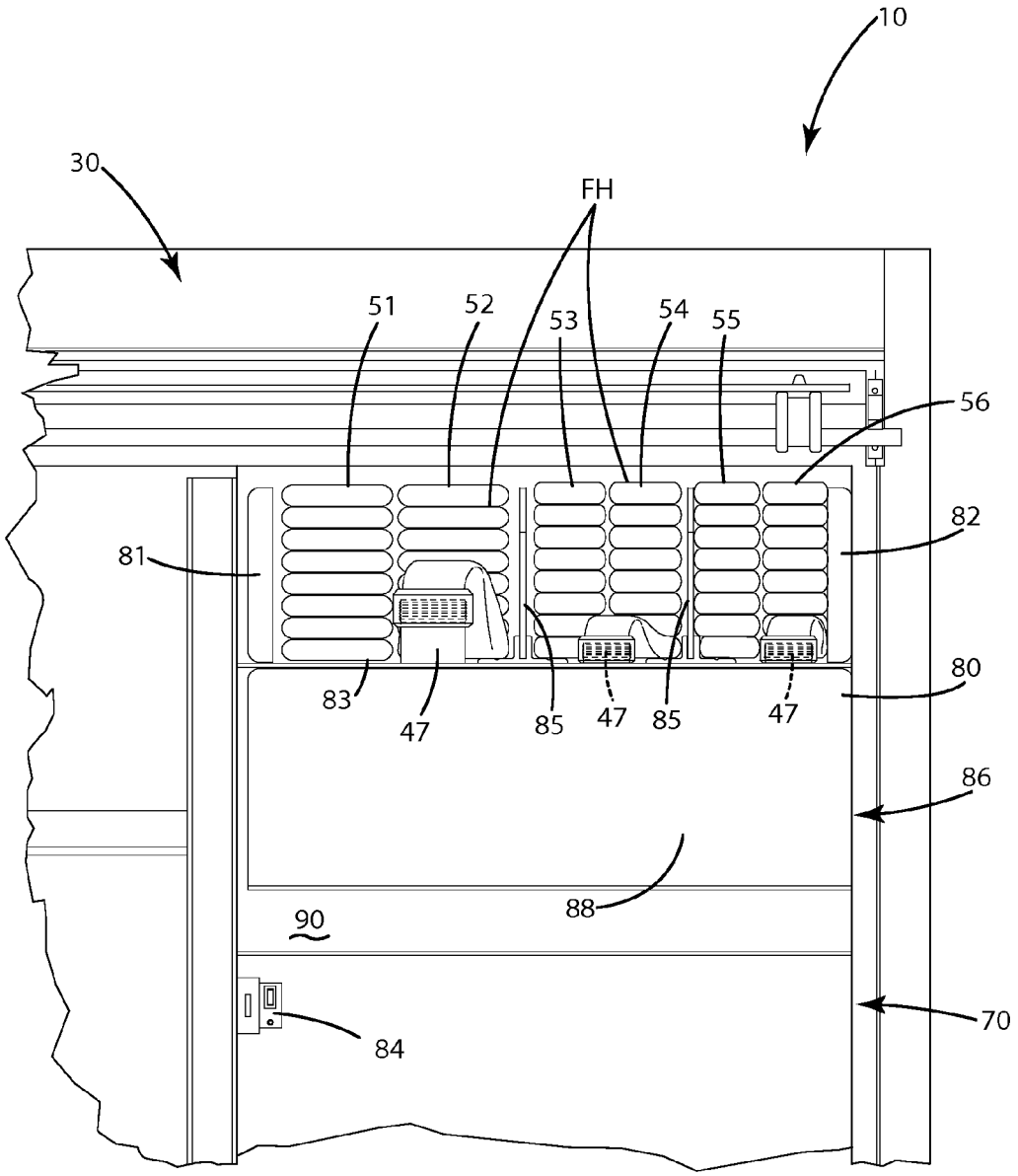
FIG. 2 is a close up of the extendable crosslay hose bed in a stored position.

As shown in FIGS. 2 and 4-7, the tray 80 can include a floor 83 and optional first and second substantially vertical sidewalls 81 and 82. Generally, these sidewalls can be integrally connected to or otherwise fastened to the floor 83 of the tray 80. Optionally, these sidewalls can also be deleted from the tray in certain applications. In some applications, the first and second sidewalls can assist in holding the fire hose FH folded over upon itself end for end multiple times in vertical columns or stacks S1-S6. To facilitate the securement of the stacks S1-S6 and ensure that they do not topple, the tray 80 optionally can include one or more divider walls 85, as shown in FIG. 2. These divider walls 85 can be secured to the floor 83 and generally, to the tray. The divider walls can be substantially vertically oriented and disposed between the first and second sidewalls 81 and 82. Although shown as including two divider walls, more or fewer divider walls 85 can be included, depending on the particular application and the number of stacks desired of fire hose FH to be supported on the tray 80. The divider walls can be fastened, bolted, screwed, or monolithically formed with the floor 83.

Figure 4:
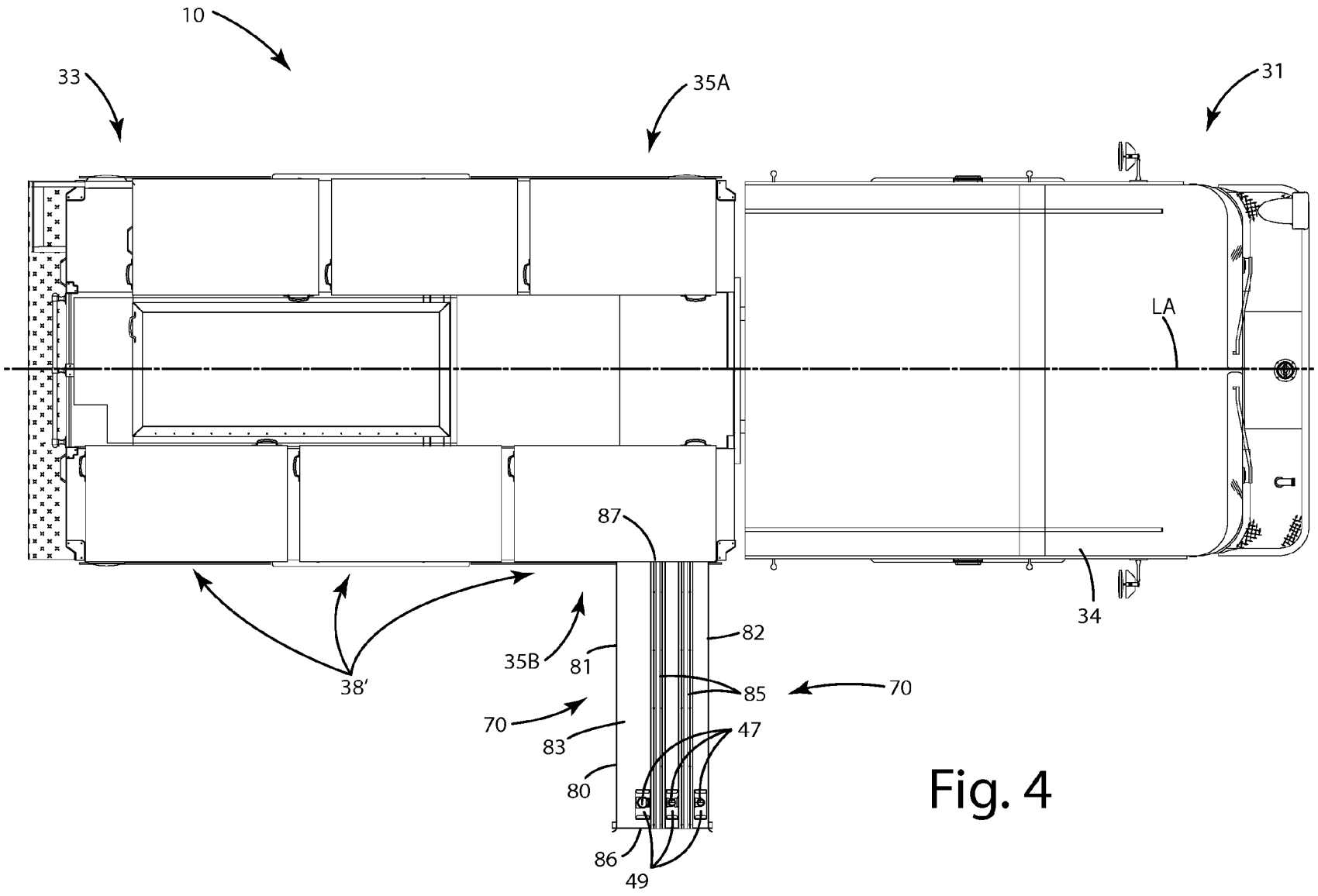
FIG. 4 is a top view of the apparatus with the tray in a deployed position.
Figure 5:
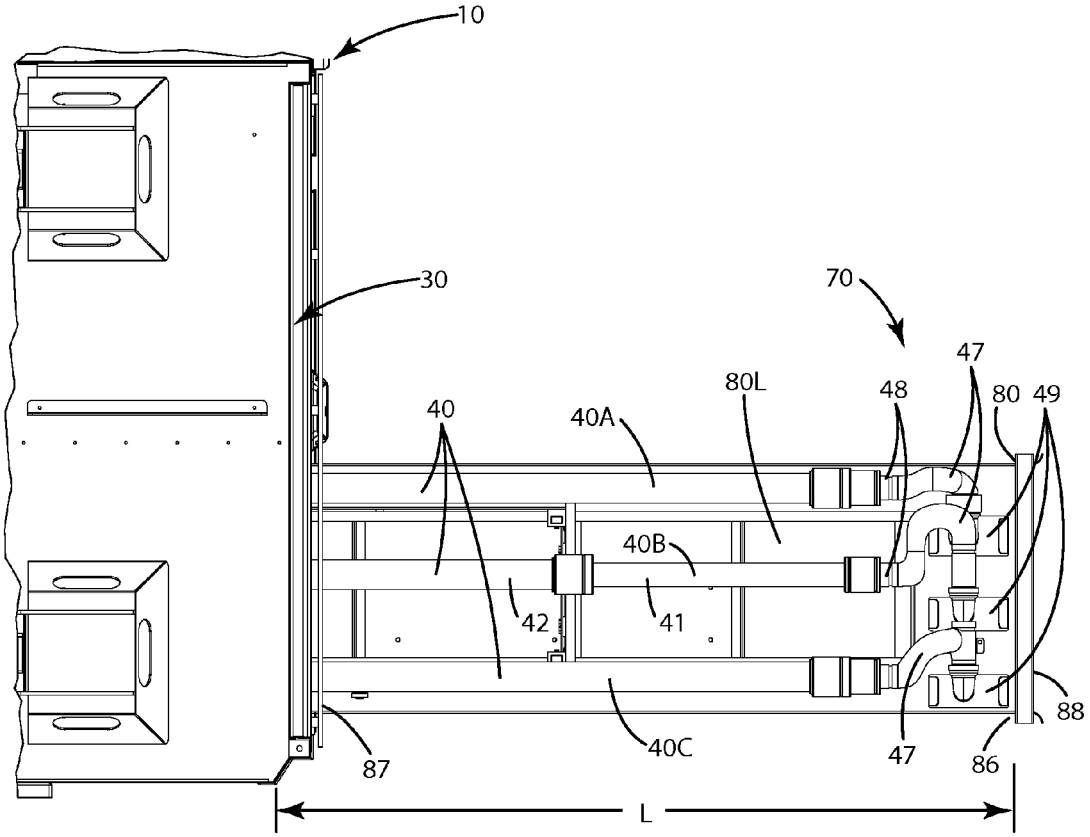
FIG. 5 is a bottom view of the apparatus with the tray in a deployed position.
Figure 6:
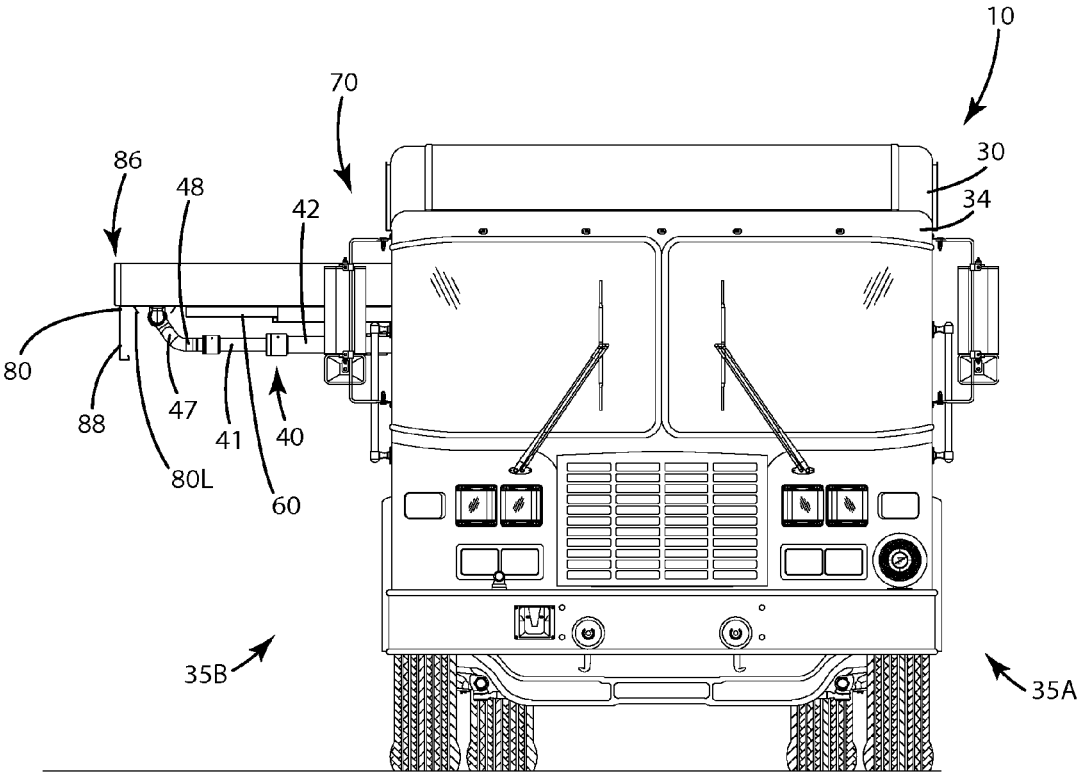
FIG. 6 is a front view of the apparatus with the tray in a partially deployed position.

As illustrated in FIG. 2, the tray 80 and more particularly the floor 83 of the tray supports multiple stacks S1-S6 of fire hose FH. This fire hose FH is generally flexible of a tubular construction. Generally, the fire hose can be constructed from a fabric, thermoplastic or laminate material adapted to withstand significant pressure of firefighting fluid being conveyed through the hose. The fire hose FH is specially stacked upon the tray 80. Generally, the hose is folded over upon itself multiple times, rather than spooled upon itself and a supportive spool. As an example, a first length of hose is loaded on the floor 83 that extends from the first end 86 of the tray to a second end 87 of the tray (FIGS. 4-5). A second length of fire hose FH is folded over upon itself, over the first length, and traverses back toward the first end 86. A third length of hose is folded back upon and over the second length, and traverses toward the second end 87. This folding continues multiple times until the entire hose is loaded on the tray 80. In some cases, extra ears or loops can be included in the fire hose near the end 86 to provide areas for a user to grasp and pull multiple lengths of folded fire hose out from the tray 80. Of course, other methods of folding and stacking fire hose can be utilized with the current embodiments. Optionally, the fire hose is not wound on a spool or rotating device, but rather stacked upon itself. Of course in some applications, the tray can support spools of hose if desired.

As shown in FIGS. 2-8, the tray 80 is movable from a stored position as shown in FIGS. 1-3 to a deployed position shown in FIGS. 4-8. In the stored position, the tray 80 is generally located substantially within the compartment 90. Likewise, the fire hose FH, folded upon and disposed on the floor 83 of the tray 80, is disposed in the compartment 90 and secure from the elements. In the deployed mode, the tray 80 extends laterally from the side 35B of the truck 10 a preselected distance. Optionally, this distance can be about 1 foot to about 8 feet, optionally about 6 feet.

As shown in FIGS. 1-2, 5 and 6, at the first end 86 of the tray 80, the crosslay hose bed can include a panel 88. This panel can be joined with the floor 83. Optionally, the panel can extend substantially vertically, and can be perpendicular to the first and second sidewalls and/or the divider walls of the tray 80. Generally, the panel 88 extends vertically downwardly from the floor 83, below the lower surface 80L of the tray a preselected distance. This distance can be about 1 foot to about 2 feet, optionally about 18 inches. The distance can be selected to conceal the underlying waterways 40 disposed under the tray 80 when the tray 80 is in a stored mode in the compartment 90. This can prevent inadvertent exposure of the waterways to the elements, debris or other things. Generally, the panel 88 can be in the form of a rectangular piece to close the lower part of the compartment 80.

The crosslay bed 70 can include one or more controls 84. These controls 84 can be accessible from the side 35B of the frame 30, or optionally within the truck, or on the opposite side 35A of the truck 10. The controls can be in the form of electrical switches, toggles, buttons, dials, or any other type of control. The controls can be in communication with the pumps 48, to control the flow of water through the waterways 40 and to the fire hose FH and/or power unit 50 to control to the extension and retraction of the tray 80 relative to the frame 30 of the truck. For example, the controls 84 can be manipulated by a user to extend the tray 80 from compartment 90, out the side 35B of the frame 30 to the deployed position as shown in FIGS. 4-8. Alternatively, the control 84 can be used to retract the tray back into the compartment 90 so that the tray 80 and fire hose FH stacked upon it is protected from the elements. Generally, the control 84 can be remote from the power unit 50 as further described below.

As shown in FIGS. 7-10, the crosslay hose bed 70 can be constructed to include a support frame 60 that removes the tray 80. The support frame 60 can be disposed under the lower surface 80L of the tray 80. The support frame can be supported by a lattice or other supports 95 in the compartment 90. The support frame 60 can be constructed from one or more members 62A, 62B that are located under the tray 80. The tray can be bolted or otherwise secured to the support frame. Optionally, the support frame members 62A, 62B can be telescopingly mounted to one another. When fully extended, the member 62A protrudes beyond member 62B on the side 35B of the frame 30.

Figure 9:
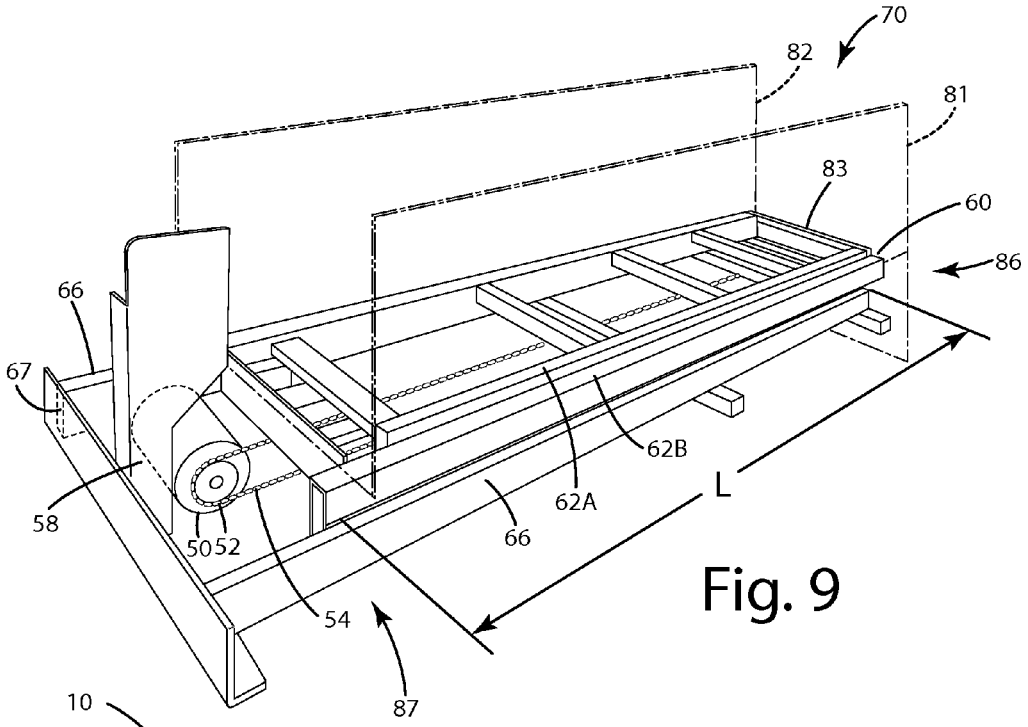
FIG. 9 is a perspective view of the tray supported on a support frame and in an undeployed position.

Generally, the support frame 60 is disposed above the waterways 40 and below the tray 80, and adapted to fit within the compartment 90 between the sidewalls 91 and 92 near the bottom 93. The support frame 60 and its members 62A, 62B can operably engage a rail 66, which can be in the form of a channel 67 (FIG. 9). The rail 67 can be positioned adjacent the support frame members 62A, 62B, and can extend along the entire length L of the support frame 60 and beyond. The rail 66 and/or members 62A, 62B can include rollers or bearings mounted thereto to assist in guiding and moving the support frame 60 from the stored position to the deployed position and vice versa. The rollers can be disposed within the channel 67 of the rail 66 to guide the support frame and thus the tray linearly inward and outward from the compartment 90 without binding. Other systems of bearings, slides and the like can be substituted or complementary to the engagement between the rail 66 and the support frame 60.

As shown in FIGS. 9 and 10, the support frame 60 and/or tray 80 is coupled to a power unit 50. The power unit as illustrated can be in the form of a motor. The motor can include a rotary driven gear 52 to which a chain 54 is mounted. The chain 54 can be further secured to the support frame 60, the members 62A, 62B. A second gear 53 can be mounted distal from the gear 52, with the chain wrapped around both. The power unit 50 drives the chain 54 to extend or retract the support frame 60 and/or tray 80 to the deployed position and/or the stored position. Although shown as a gear driven chain, the drive unit 56 can be in the form of a belted drive, a screw drive, a pneumatic or hydraulic ram operated drive. Likewise, although shown as an electric motor, the power unit can be substituted with a hydraulic or pneumatic apparatus which can include rams, cylinders, screws, belts or other structures attached to the support frame 60 and/or its components to move the tray and support frame 60 in a desired manner from the deployed position to the stored position and vice versa.

The power unit 50 can be mounted within the compartment 90. Generally, it can be disposed in a stationary position, mounted to a power unit mount 58, which is further mounted to the frame 30 with the tray 80 and support frame 60 being moveable relative to it and the compartment 90.

The power unit can be electrically coupled to the control 84. Generally, the power unit can receive signals from the control 84 which determine whether the power unit rotates the gear in one direction or another to thereby drive the chain and move the attached tray accordingly.

As shown in FIGS. 5-8, the crosslay hose bed 70 includes one or more waterways 40. As illustrated, there are three waterways 40A, 40B and 40C. These can generally correspond to three different sets of fire hose, optionally of different sizes. Each of the waterways 40A, 40B and 40C can be joined or in fluid communication with specific dedicated fire hoses that are stacked on the tray 80. The waterways can be constructed as elongated self-supporting tubes. Generally, each of the waterways can include a first rigid elongated tube 41 and a second rigid elongated tube 42. The first and second tubes can be telescopically joined with one another so that as the tray extends to the deployed position, the first and second tubes 41, 42 move relative to one another. In this way, the waterway can increase in length in a sealed manner and still convey firefighting fluid therethrough when the tray is moved from the stored position to the deployed position and vice versa. Optionally, the first and second tubes 41, 42 can be fit one inside the other, with the diameter of the first tube 41 smaller than the diameter of the second tube 42 to enable interfittment and nesting of the tubes. Generally, the telescoping tubular portions of the waterways can cooperate with one another to provide a continuous fluid passageway along the length L of the tray 80.

The waterways 40 are operable to transfer a continuous supply of firefighting fluid to a water outlet 48 of the respective waterway. The water outlet 48 can be in fluid communication with a connector 47 that is further in fluid communication with and connected to the fire hose FH. Generally, the waterways 40 receive pressurized firefighting fluid from one or more pumps 48 that are mounted toward the second end 87 of the tray 80 inside the compartment 90 (FIG. 12).

As mentioned above, the waterways can be self-supporting and rigid. They can be constructed from metals or composites that provide a structural rigidity so that they are not generally foldable or deformable without ruining the structural integrity of the waterways.

Figure 11:
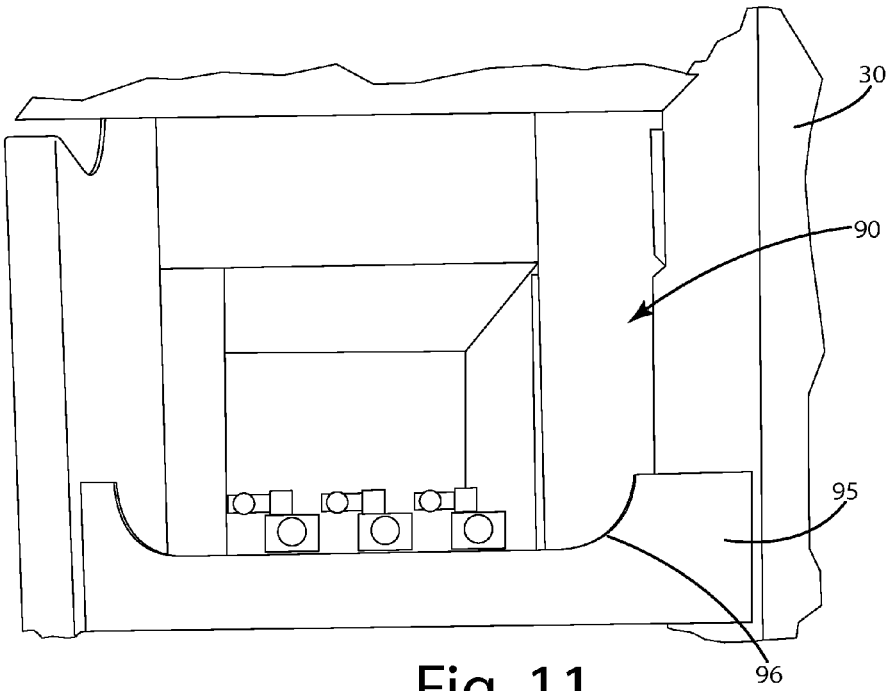
FIG. 11 is a side view of a crosslay hose bed compartment with the tray removed.
Figure 12:
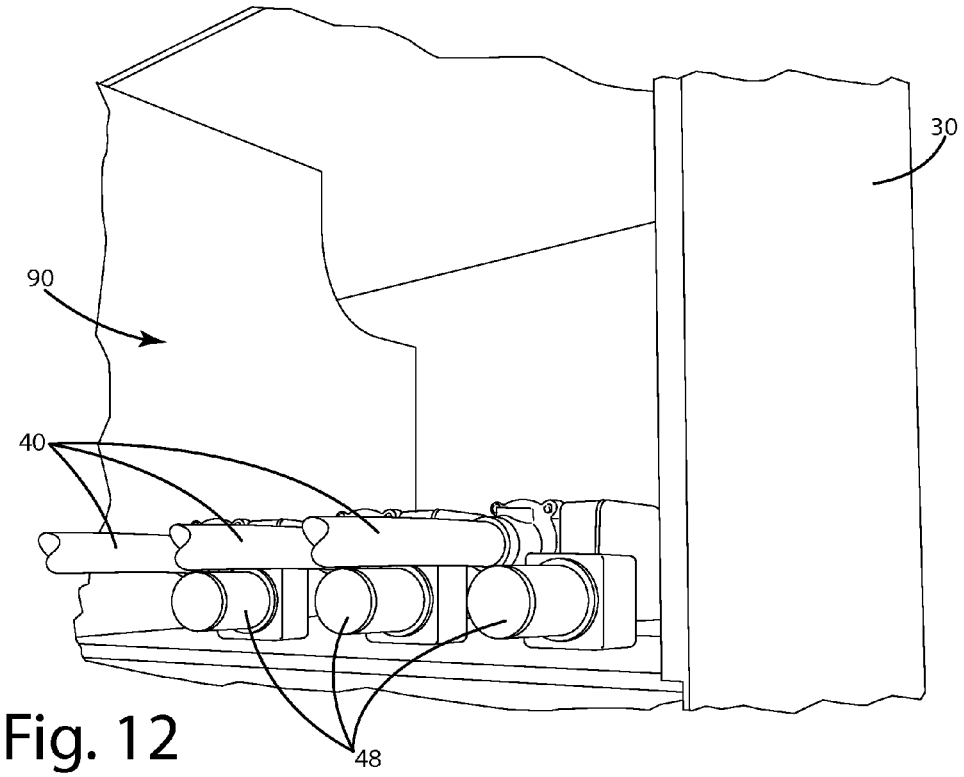
FIG. 12 is a perspective view of pumps associated with one or more waterways of the tray.

As shown in FIGS. 11 and 12, the pumps 48 are generally mounted within the compartment 90. In this manner, they are concealed and otherwise protected from the elements. The pumps are in fluid communication with the waterways 40.

The waterways are connected to the fire hose with one or more connectors 47. The connectors 47 can be elbows having fittings on opposing ends. The fittings can join with the respective waterway and the hose. Optionally, the fitting can be in the form of a quick coupler to enable the fire hose FH to be rapidly attached and detached from the connector 47.

As shown in FIGS. 4 and 5, the tray 80 can define one or more apertures 49 through which the connectors 47 are disposed. Generally, the connectors 47 extend upwardly through the apertures. These connectors 47 divert firefighting fluid being transported under the lower surface 80L of the tray 80 to a location above the upper surface 80U of the tray and generally into the fire hose. The connectors can establish fluid communication between the waterways and the fire hose.

Operation of the firefighting or rescue apparatus of the current embodiments will now be described. The firefighting apparatus 10, optionally in the form of a pumper fire truck can be used to fight fires in buildings or other structures, and/or on the ground. The truck 10 is particularly useful in pumping large amounts of volumes of water to suppress or extinguish a fire. Generally, upon arriving at an emergency location where a fire needs to be suppressed, a user can exit the cab 34 of the truck 10 and approach the crosslay hose bed 70. Optionally, a door (not shown) can conceal the contents of the crosslay hose bed 70 and in particular the fire hose as desired. The door can be opened so that the fire hose FH and the crosslay hose bed 70 is exposed. One or more users can then grasp the fire hose FH and pull it from the stacks, out of the crosslay hose bed, generally off of a tray, while the tray remains and/or support frame remains in the stored position.

After the hose is extended and placed in an appropriate location, a user can operate controls on a pump panel on the driver side of the truck (not shown) to selectively open valves and/or selectively start the pumps 36P/48 to start pumping fluid through the waterways 40, through the connector 47 and out the fire hose FH. Where the waterways include one or more valves associated with the connectors 47, the pump controls also can be used to modify the configuration of the valves to provide a desired flow of firefighting fluid through the waterways 40A, 40B, 40C to the fire hose FH.

After the fire hose has been fully utilized at an emergency location, the fire hose FH is loaded back onto the tray 80. To achieve this, the tray is operated to move it from its stored position within the truck, frame and compartment, to a deployed position so that the tray extends outwardly from the side 35B of the truck 10 a preselected distance. A user engages the controls 84 to execute the extension of the tray 80 and support frame 60 from the truck and in particular the lateral side 35B of the truck the preselected distance. When the user engages the controls 84, the power unit 50 is actuated. The power unit rotates the gear 52 which in turn moves the chain 54. Due to its attachment to the support frame 60 and/or the members 62A, 62B, the chain 54 exerts a force on the support frame to extend it and move it outward from the stored position to the deployed position. Optionally, the member 62A telescopes and/or moves relative to the member 62B during the extension. As the tray 80 extends from the stored position to the deployed position as shown in FIGS. 5-8, the waterways 40, in particular the first and second tubular members 41, 42 telescope relative to one another to increase the overall length of the waterways 40. After the tray and support frame are adequately extended, the power unit 50 can automatically shut down, indicating to a user that the tray is fully extended to the deployed mode.

With the tray in the deployed mode, the user can stack fire hose 89 back on the floor 83 of the tray, generally folding the hose end for end along the length L of the tray and extending from the first end 86 to the second end 87. Optionally, the user can include ears or loops of hose that extend beyond the remainder of the hose, and in particular, the stacks, so that the user or others can easily grasp the hose and pull it from the bed during the next use.

When loading of the fire hose FH on the tray 80 is complete, the user may then actuate the control 84 again which in turn actuates the power unit 50. The power unit 50 rotates the gear 52 in a different direction, which in turn moves the chain and pulls the support frame 60 and tray 80 back into the compartment 90. The tray and support frame are in the stored position, with the fire hose being stacked thereupon. In this manner, the fire hose can be loaded and retracted into the compartment 90 for safekeeping for the next run.

After the truck 10 is no longer needed at the emergency location, it can be mobilized back to its garage or station.

Figure 13:
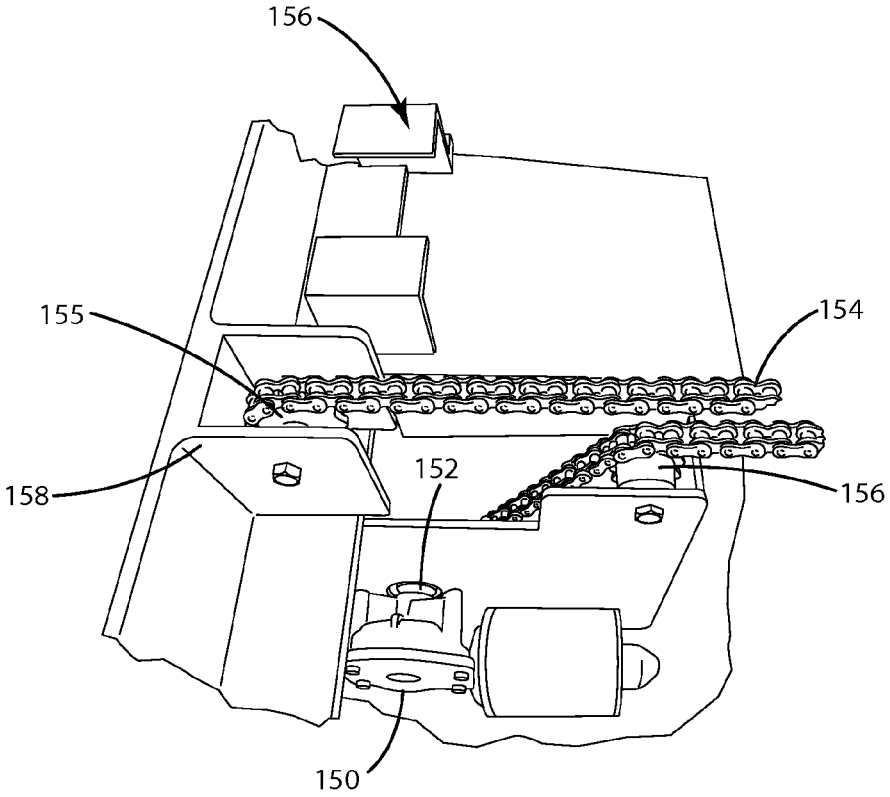
FIG. 13 is a top perspective view of a drive unit joined with the tray.
Figure 14:
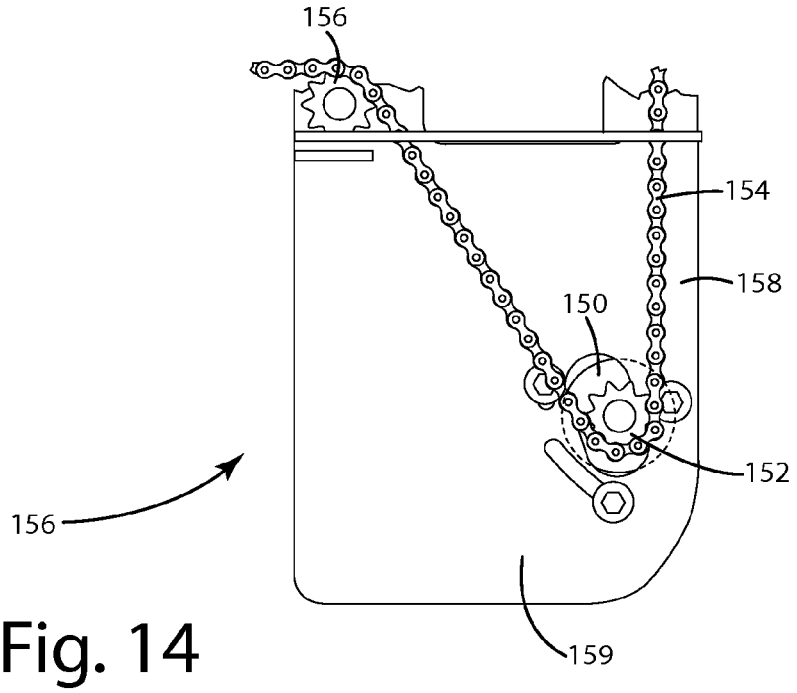
FIG. 14 is a bottom perspective view of the drive unit joined with the tray.

A first alternative embodiment of a drive unit 156 associated with the tray is illustrated in FIGS. 13-14. This embodiment is similar in structure, operation and function as the drive unit 56 above, with several exceptions. For example, the power unit 150 can be mounted to a downwardly extending support plate 159. The power unit 150 can be joined with a gear 152. A chain 154 is wrapped partially around and engages the gear. The chain extends upwardly to a second gear or sprocket 155 extending at least partially around the same. Chain 154 then extends outward away from the drive unit to attach to the support frame and/or one or more members as in the embodiment above. The second portion of the chain 154 extends upwardly and over a roller 156. In this manner, two portions of chain, one above the other, can extend outwardly toward the support frame and/or related members and be joined with the same for movement via operation of the power unit 150. If desired, the roller 156 can be replaced with another sprocket or gear, depending on the particular application. Of course, other configurations for the drive unit 156 can be substituted for those illustrated in the figures and described above.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A firefighting apparatus comprising:

a frame configured to enable transportation of the apparatus to an emergency location, the frame including a forward portion, a rearward portion, a left side and a right side opposite the left side, and a rear axle mounted to the frame in the rearward portion, the frame having a side to side width and including a longitudinal axis extending from the forward portion toward the rearward portion;

a tray mounted to the frame, the tray moveable in a direction transverse to the longitudinal axis and transverse to a vertical axis from a stored position to a deployed position in which the tray extends transverse to the longitudinal axis of the frame and outwardly from at least one of the left side and the right side of the frame, distal from the rearward portion of the frame, the tray including a floor adapted to support flexible fire hose folded over upon itself a plurality of times and oriented in at least one stack, the tray including a lower surface;

a waterway located below the lower surface of the tray and mounted under and joined with the tray, the waterway constructed from a first tube and a second tube telescopingly joined with one another so that the waterway can increase in length when the tray is moved from the stored position to the deployed position, the waterway adapted to convey firefighting fluid therethrough;

a control configured to control movement of the tray;

wherein the control is operable by a user to move the tray from the stored position to the deployed position, whereby in the deployed position the user can load the fire hose onto the tray.

2. The firefighting apparatus of claim 1 wherein the tray defines an aperture, wherein a connector is disposed through the aperture and connects the waterway to the fire hose, wherein the aperture and the connector are disposed on a distal end of the tray such that when the tray is moved to the deployed position, the aperture and the connector are laterally spaced from at least one of the left side and the right side of the frame.

3. The firefighting apparatus of claim 2 wherein the tray includes opposing sides and an upwardly standing divider wall positioned between the opposing sides of the tray, the divider wall adapted to segregate a first stack of fire hose from a second stack of fire hose.

4. The firefighting apparatus of claim 1 wherein the tray includes a first sidewall and a second sidewall opposite the first sidewall, the first and second sidewalls being joined with the floor of the tray.

5. The firefighting apparatus of claim 4 wherein the tray includes an outwardly facing vertical panel, the panel being perpendicular to the first and second sidewalls and extending downward from the lower surface of the tray.

6. The firefighting apparatus of claim 5 wherein the control is mounted on the frame.

7. The firefighting apparatus of claim 1 comprising a power unit joined with the tray and configured to move the tray from the stored position to the deployed position, wherein the control is in communication with the power unit for operation of the power unit, wherein the control is remote from the tray.

8. A firefighting apparatus comprising:

a mobile frame including a forward portion and a rearward portion, a rear axle located in the rearward portion, and a left side and a right side opposite the left side, the frame including a longitudinal axis extending from the forward portion toward the rearward;

a tray mounted to the frame, the tray including a tray axis transverse to the longitudinal axis, the tray moveable along the tray axis in a direction transverse to the longitudinal axis and transverse to a vertical axis from a stored position to a deployed position in which the tray extends laterally, transverse to the longitudinal axis of the frame and outwardly from at least one of the left side and the right side of the frame, distal from the rearward portion of the frame, and between a front axle and the rear axle, a plurality of stacks of flexible fire hose folded over upon itself, the plurality of stacks of flexible fire hose disposed on the tray;

a power unit joined with the tray and configured to move the tray from the stored position to the deployed position with the plurality of stacks of flexible fire hose on the tray;

a control in communication with the power unit for operation of the power unit; and a waterway located below a lower surface of the tray and mounted under and joined with the tray, the waterway constructed from a first, self-supporting, elongated tube and a second, self-supporting, elongated tube telescopingly joined with one another so that the waterway can increase in length when the tray is moved from the stored position to the deployed position, the waterway adapted to convey firefighting fluid therethrough, wherein the control is operable by a user to move the tray from the stored position to the deployed position, whereby in the deployed position the user can load the fire hose onto the tray.

9. The firefighting apparatus of claim 8 wherein the tray includes a horizontal floor, a first vertical sidewall and a second vertical sidewall opposite the first vertical sidewall, and a divider extending upward from the floor between the first and second sidewalls.

10. The firefighting apparatus of claim 8 comprising a connector joined with the waterway and the fire hose so that the waterway and the fire hose are in fluid communication with one another.

11. The firefighting apparatus of claim 10 wherein the tray includes a horizontal floor and an aperture in the floor, wherein the connector extends through the aperture, wherein the aperture and the connector are disposed on a distal end of the tray such that when the tray is moved to the deployed position, the aperture and the connector are spaced from at least one of the left side and the right side of the frame.

12. A firefighting apparatus comprising:

a frame including a plurality of wheels configured to enable transportation of the apparatus to an emergency location, the frame including a forward portion having a cab for housing at least one occupant of the apparatus, a rearward portion located rearward of the cab, a left side and a right side opposite the left side, the frame including at least one rear axle mounted to the frame in the rearward portion, the frame having a side to side width and including a longitudinal axis extending from the forward portion toward the rearward portion;

a compartment defined by the frame forward of the rear axle, behind the cab, the compartment disposed laterally across at least a portion of the width of the frame and transverse to the longitudinal axis of the frame;

a tray mounted in the compartment, the tray moveable in a direction transverse to the longitudinal axis and transverse to a vertical axis from a stored position in which the tray is located substantially in the compartment, to a deployed position in which the tray extends transverse to the longitudinal axis of the frame and outwardly from at least one of the left side and the right side of the frame a preselected distance, the tray including an upper surface that forms a floor adapted to support flexible fire hose folded over upon itself a plurality of times and oriented in at least one stack, the tray including a lower surface opposite the upper surface, the tray including a first sidewall and a second sidewall opposite the first sidewall, the first and second sidewalls being joined with the floor of the tray;

a waterway including a water outlet, the waterway located below the lower surface of the tray and mounted under and joined with the tray, the water outlet adapted to join with the fire hose, the waterway constructed from a first, elongated tube and a second elongated tube, the first and second tubes telescopingly joined with one another so that the waterway can increase in length when the tray is moved from the stored position to the deployed position, but still convey firefighting fluid therethrough;

a pump mounted to the frame and adapted to pump firefighting fluid to the waterway;

a power unit joined with the tray and configured to move the tray from the stored position to the deployed position;

a control in communication with the power unit for operation of the power unit, wherein the control is operable by a user to actuate the power unit and move the tray from the stored position to the deployed position, whereby in the deployed position the user can load fire hose onto the tray.

13. The firefighting apparatus of claim 12 wherein the tray is moveable along a tray axis that is perpendicular to the longitudinal axis.

14. The firefighting apparatus of claim 13, wherein the power unit is a motor, wherein the motor is joined with a chain operably connected to the tray, the chain being selectively driven by the motor to move the tray from the stored position to the deployed position.

15. The firefighting apparatus of claim 12 comprising a support frame mounted to the tray, the support frame constructed from a plurality of members that structurally reinforce and support the tray.

16. The firefighting apparatus of claim 15 comprising a channel operably engaged to the support frame and at least one roller joined with the support frame, the roller being rollingly disposed in relation to the channel to assist in guiding the tray from the stored position to the deployed position.

17. The firefighting apparatus of claim 12 wherein the power unit is a hydraulic unit adapted to move the tray.

18. The firefighting apparatus of claim 12 comprising a panel joined with the tray, the panel facing outward from the tray and physically accessible from a side of the frame.

19. The firefighting apparatus of claim 18 wherein the control is mounted to the firefighting apparatus such that a user can operate the control while the tray is in the stored position to move the tray to the deployed position.

* * * * *